US010319168B2

(12) United States Patent
Liu et al.

(10) Patent No.: US 10,319,168 B2
(45) Date of Patent: Jun. 11, 2019

(54) QUALITY CONTROL METHOD FOR PAPER MONEY AUTHENTICATION AND SYSTEM THEREFOR

(71) Applicant: GRG Banking Equipment Co., Ltd., Guangzhou, Guangdong (CN)

(72) Inventors: Siwei Liu, Guangdong (CN); Rongqiu Wang, Guangdong (CN); Gang Lei, Guangdong (CN); Zheng Zhao, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 6 days.

(21) Appl. No.: 15/543,559

(22) PCT Filed: Jul. 13, 2015

(86) PCT No.: PCT/CN2015/083863

§ 371 (c)(1),
(2) Date: Jul. 13, 2017

(87) PCT Pub. No.: WO2016/115845

PCT Pub. Date: Jul. 28, 2016

(65) Prior Publication Data

US 2018/0040186 A1 Feb. 8, 2018

(30) Foreign Application Priority Data

Jan. 19, 2015 (CN) ..... 2015 1 0026756

(51) Int. Cl.
*G07D 7/1205* (2016.01)
*G07D 7/12* (2016.01)
*G07D 7/187* (2016.01)

(52) U.S. Cl.
CPC ..... *G07D 7/1205* (2017.05); *G07D 7/12* (2013.01); *G07D 7/187* (2013.01)

(58) Field of Classification Search
CPC ..... G07D 7/1205; G07D 7/187; G07D 7/12; H05K 999/99
(Continued)

(56) References Cited

U.S. PATENT DOCUMENTS 6,628,808 B1 * 9/2003 Bach ..... G06K 9/036 235/380
6,788,813 B2 9/2004 Cooper
(Continued)

FOREIGN PATENT DOCUMENTS

CN 1795467 A 6/2006
CN 101826232 A 9/2010
(Continued)

OTHER PUBLICATIONS

PCT/CN2015/083863, Sep. 25, 2015, International Search Report.
(Continued)

*Primary Examiner* — Amandeep Saini
(74) *Attorney, Agent, or Firm* — Wolf, Greenfield & Sacks, P.C.

(57) ABSTRACT

Provided are a quality control method for banknote identification and a quality control system for banknote identification. The quality control method for banknote identification includes: obtaining a multispectral signal collected by a contact image sensor (CIS); extracting a first eigenvalue of the multispectral signal; obtaining a corresponding second eigenvalue according to the first eigenvalue and a pre-set correction conversion value; and inputting the second eigenvalue into a banknote classifier to obtain a corresponding banknote classification result.

10 Claims, 10 Drawing Sheets

(58) Field of Classification Search
USPC ..... 382/112
See application file for complete search history.

(56) References Cited

U.S. PATENT DOCUMENTS

| | | | | |
|---|---|---|---|---|
| 2006/0251320 | A1* | 11/2006 | Diederichs ..... | B41F 33/0036 382/165 |
| 2010/0157396 | A1 | 6/2010 | Kim et al. | |
| 2012/0045112 | A1 | 2/2012 | Lundblad et al. | |
| 2016/0110940 | A1 | 4/2016 | Huang et al. | |

FOREIGN PATENT DOCUMENTS

| | | | | |
|---|---|---|---|---|
| CN | 102568079 | A | | 7/2012 |
| CN | 103108107 | A | | 5/2013 |
| CN | 103139430 | A | | 6/2013 |
| CN | 103200349 | A | | 7/2013 |
| CN | 203133996 | U | | 8/2013 |
| CN | 103297654 | A | | 9/2013 |
| CN | 103310528 | A | | 9/2013 |
| CN | 103413368 | A | | 11/2013 |
| CN | 203632743 | U | | 6/2014 |
| CN | 104019902 | A | | 9/2014 |
| CN | 104019902 | A | * | 9/2014 |
| CN | 104732644 | A | | 6/2015 |
| EP | 2 187 359 | A1 | | 5/2010 |
| EP | 2 246 825 | A1 | | 11/2010 |
| EP | 2 743 863 | A1 | | 6/2014 |
| EP | 3 021 293 | A1 | | 5/2016 |
| JP | 2005-352604 | A | | 12/2005 |
| RU | 2 424 909 | C2 | | 7/2011 |
| WO | WO 2007/110155 | A1 | | 10/2007 |
| WO | WO 2015/003485 | A1 | | 1/2015 |

OTHER PUBLICATIONS

EP 15878516.2, Jan. 3, 2018, Extended European Search Report.
Extended European Search Report for Application No. EP 15878516.2 dated Jan. 3, 2018.
Han et al., Color Correction Method for CMOS Camera Phone Image. Consumer Electronics, 2004 IEEE International Symposium on Reading. Sep. 2004;138-41.
International Search Report for Application No. PCT/CN2015/083863 dated Sep. 25, 2015.
Russian 1st Office Action dated Jul. 10, 2018 for Application No. 2017128817/08(049861).

* cited by examiner

QUALITY CONTROL METHOD FOR PAPER MONEY AUTHENTICATION AND SYSTEM THEREFOR

CROSS-REFERENCE TO RELATED APPLICATIONS

The present application is a National Stage application of PCT international patent application PCT/CN2015/083863, filed on Jul. 13, 2015 which claims priority to Chinese Patent Application No. 201510026756.8, titled "QUALITY CONTROL METHOD FOR PAPER MONEY AUTHENTICATION AND SYSTEM THEREFOR", filed on Jan. 19, 2015 with the State Intellectual Property Office of the People's Republic of China, both of which applications are incorporated herein by reference in their entireties.

FIELD

The present disclosure relates to the field of quality control of multispectral signal, and in particular to a quality control method for banknote identification and a system thereof.

BACKGROUND

A banknote identification module is a core component of a financial self-service device, and is configured to identify the denomination, authenticity and quality of a banknote in the process of a cash transaction. A core element of the banknote identification module is a CIS (contact image sensor). The banknote identification module collects multispectral signals of a banknote by the CIS, and performs denomination identification, authenticity identification and quality sorting of a banknote by using characteristics of multispectral imaging of the banknote. For a visible light signal of a previous generation of banknote identification modules, only a natural white light signal is used. While, for a visible light signal of a new generation of banknote identification modules, at least three optical signals are used, including a red light signal, a green light signal and a blue light signal, and level of color information can reach a level of true colors, which significantly improves the reliability and accuracy of banknote identification, in particular for some altered banknotes with a high counterfeit degree, as compared with the detection with the natural white light signal.

It can be seen from above that the accuracy of banknote identification is closely related to the performance of the CIS. However, due to a difference in the manufacturing process, not all of the factory-fresh CISs can be entirely the same and there are some differences more or less in the performance. In the existing banknote identification technology, multispectral signals are generally collected by a CIS, and color eigenvalues corresponding to the multispectral signals are extracted and transmitted to a banknote classifier for banknote classification processing.

However, since there is a difference in performance among the CISs, multispectral signals collected by different CISs for a same one banknote may also be different, which causes a difference in the finally obtained banknote classification result, thereby affecting the accuracy of banknote identification and resulting in a risk of mistaken identification.

SUMMARY

A quality control method for banknote identification and a system thereof are provided according to embodiments of the present disclosure, for solving the technical problems that the accuracy of banknote identification is affected and there is a risk of mistaken identification, because of a difference in the obtained banknote classification result caused by a difference in the CIS performance.

A quality control method for banknote identification is provided according to an embodiment of the present disclosure, which includes:

obtaining a multispectral signal collected by a CIS;

extracting a first eigenvalue of the multispectral signal;

obtaining a corresponding second eigenvalue according to the first eigenvalue and a pre-set correction conversion value; and inputting the second eigenvalue into a banknote classifier to obtain a corresponding banknote classification result.

Optionally, the method may further include:

obtaining a standard eigenvalue corresponding to a multispectral signal collected by a standard CIS;

obtaining a color eigenvalue corresponding to a multispectral signal collected by a CIS to be detected; and obtaining a correction conversion value according to the standard eigenvalue and the color eigenvalue, where the correction conversion value includes a conversion relation between the standard eigenvalue and the color eigenvalue.

Optionally, the method may further include:

performing white balance detection on a multispectral signal outputted by the CIS.

Optionally, the detailed process of performing white balance detection on the multispectral signal outputted by the CIS may include:

performing white balance detection of white paper on the multispectral signal outputted by the CIS; or performing white balance detection of black paper on the multispectral signal outputted by the CIS.

Optionally, the method may further include:

determining whether the CIS passes the white balance detection, where the step of obtaining a multispectral signal collected by a CIS is performed in a case that it is determined that the CIS passes the white balance detection.

A quality control system for banknote identification is provided according to an embodiment of the present disclosure, which includes:

a first obtaining module configured to obtain a multispectral signal collected by a CIS;

an extracting module configured to extract a first eigenvalue of the multispectral signal;

a converting module configured to obtain a corresponding second eigenvalue according to the first eigenvalue and a pre-set correction conversion value; and a classifying module configured to input the second eigenvalue into a banknote classifier to obtain a corresponding banknote classification result.

Optionally, the system may further include:

a second obtaining module configured to obtain a standard eigenvalue corresponding to a multispectral signal collected by a standard CIS;

a third obtaining module configured to obtain a color eigenvalue corresponding to a multispectral signal collected by a CIS to be detected; and a correction value obtaining module configured to obtain a correction conversion value according to the standard eigenvalue and the color eigenvalue, where the correction conversion value includes a conversion relation between the standard eigenvalue and the color eigenvalue.

Optionally, the system may further include:

a white balance detection module configured to perform white balance detection on a multispectral signal outputted by the CIS.

Optionally, the white balance detection module may include:

a white paper detection unit configured to perform white balance detection of white paper on the multispectral signal outputted by the CIS; or a black paper detection unit configured to perform white balance detection of black paper on the multispectral signal outputted by the CIS.

Optionally, the system may further include:

a determining module configured to determine whether the CIS passes the white balance detection; and a triggering module configured to trigger the first obtaining module, in a case that a determination result of the determining module is positive.

It can be seen from above technical solutions that the embodiments of the present disclosure have the following advantages.

According to the embodiments of the present disclosure, a multispectral signal collected by a CIS is obtained, a first eigenvalue of the multispectral signal is extracted, a corresponding second eigenvalue is obtained according to the first eigenvalue and a pre-set correction conversion value, and the second eigenvalue is inputted into a banknote classifier to obtain a corresponding banknote classification result. In the embodiments of the present disclosure, after the first eigenvalue of the multispectral signal is obtained, the corresponding second eigenvalue is obtained according to the first eigenvalue and the pre-set correction conversion value to perform correction processing on the first eigenvalue, which eliminates a deviation brought by a difference in the CIS performance, thereby eliminating a difference in the finally obtained banknote classification result, ensuring the accuracy of banknote identification and eliminating a risk of mistaken identification.

DETAILED DESCRIPTION OF EMBODIMENTS

A quality control method for banknote identification and a system thereof are provided according to embodiments of the present disclosure, to solve the technical problems that the accuracy of banknote identification is affected and there is a risk of mistaken identification, because of a difference in the obtained banknote classification result caused by a difference in the CIS performance.

Figure 1:
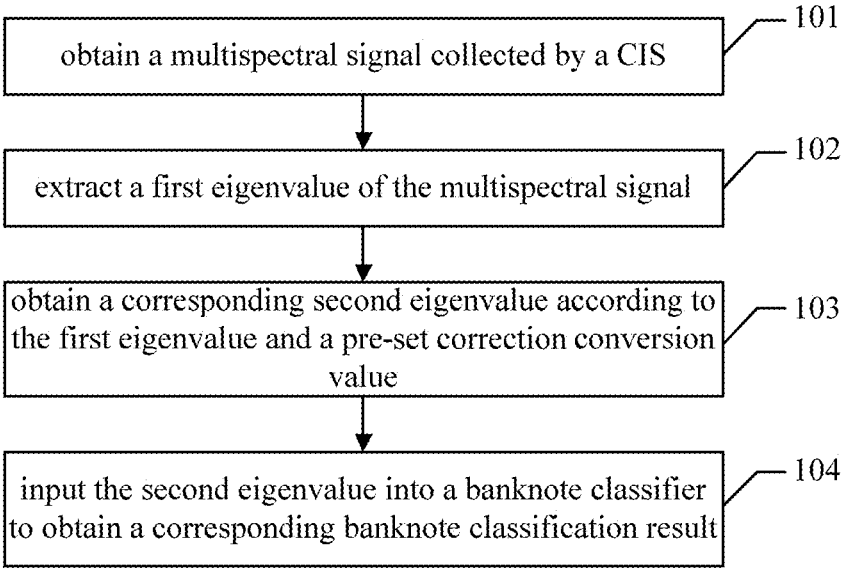
FIG. 1 is a flow chart of a quality control method for banknote identification according to an embodiment of the present disclosure.

In order to make the objects, features and advantages of the present disclosure clearer and easier to understand, hereinafter the technical solutions of the embodiments of the present disclosure are illustrated clearly and completely in conjunction with drawings of the embodiments of the present disclosure. Apparently, the described embodiments are merely a few rather than all of the embodiments of the present disclosure. All other embodiments obtained by persons of ordinary skill in the art based on the embodiments of the present disclosure without creative efforts shall fall within the protection scope of the present disclosure. Reference is made to FIG. 1. In an embodiment of the present disclosure, a quality control method for banknote identification includes steps 101 to 104.

In step 101, a multispectral signal collected by a CIS is obtained.

First, the multispectral signal collected by the CIS may be obtained.

In step 102, a first eigenvalue of the multispectral signal is extracted.

After the multispectral signal collected by the CIS is obtained, the first eigenvalue of the multispectral signal may be extracted.

In step 103, a corresponding second eigenvalue is obtained according to the first eigenvalue and a pre-set correction conversion value.

After the first eigenvalue of the multispectral signal is extracted, the corresponding second eigenvalue may be obtained according to the first eigenvalue and the pre-set correction conversion value.

In step 104, the second eigenvalue is inputted into a banknote classifier to obtain a corresponding banknote classification result.

After the corresponding second eigenvalue is obtained according to the first eigenvalue and the pre-set correction conversion value, the second eigenvalue may be inputted into the banknote classifier to obtain the corresponding banknote classification result.

In this embodiment, a multispectral signal collected by a CIS is obtained, a first eigenvalue of the multispectral signal is extracted, a corresponding second eigenvalue is obtained according to the first eigenvalue and a pre-set correction conversion value, and the second eigenvalue is inputted into a banknote classifier to obtain a corresponding banknote classification result. In this embodiment, after the first eigenvalue of the multispectral signal is obtained, the corresponding second eigenvalue is obtained according to the first eigenvalue and the pre-set correction conversion value to perform correction processing on the first eigenvalue, which eliminates a deviation brought by a difference in the CIS performance, thereby eliminating a difference in the finally obtained banknote classification results, ensuring the accuracy of banknote identification and eliminating a risk of mistaken identification.

Figure 2:
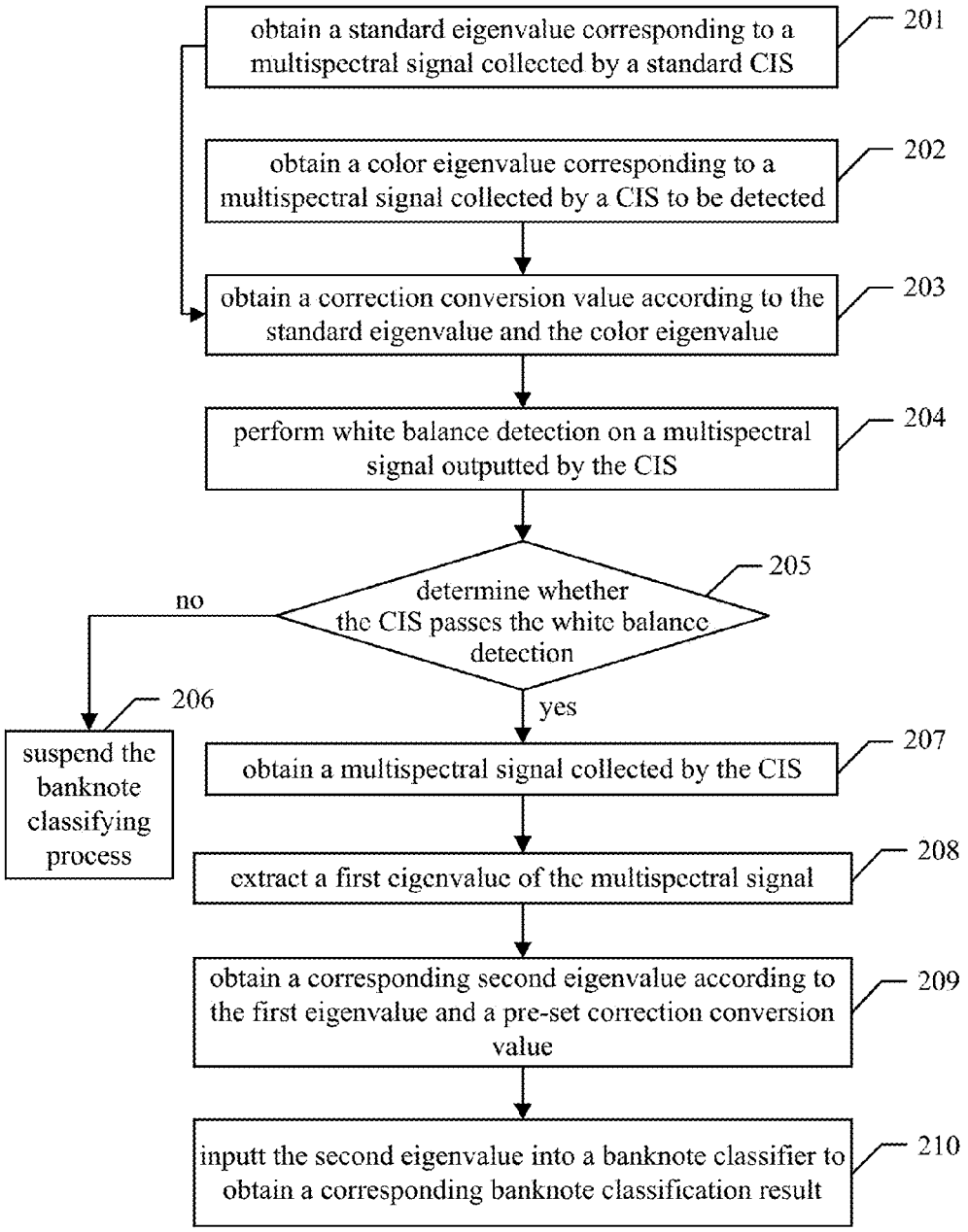
FIG. 2 is a flow chart of a quality control method for banknote identification according to another embodiment of the present disclosure.

For ease of understanding, the quality control method for banknote identification according to the embodiment of the present disclosure is described below in detail. Reference is made to FIG. 2. In another embodiment of the present disclosure, a quality control method for banknote identification includes steps 201 to 210.

In step 201, a standard eigenvalue corresponding to a multispectral signal collected by a standard CIS is obtained.

Before performing classification processing on a banknote, the standard eigenvalue corresponding to the multispectral signal collected by the standard CIS is obtained. The standard CIS is a CIS with a high color accuracy. A multispectral signal outputted by the standard CIS may be regarded to be accurate and as a reference signal for designing a banknote classifier, thereby developing and designing a standard banknote classifier.

It should be noted that, the standard eigenvalue may include base values of multiple colors of the standard CIS. For example, multiple colors may be selected, such as five colors, which are red, green, blue, yellow and purple, and standard checking papers of those colors are printed. An image of a red paper, an image of a green paper, an image of a blue paper, an image of a yellow paper and an image of a purple paper are respectively collected for m times by the standard CIS, and color features are respectively recorded for each time, thereby obtaining color base values in the standard CIS corresponding to those standard values.

In step 202, a color eigenvalue corresponding to a multispectral signal collected by a CIS to be detected is obtained.

Similarly, before performing classification processing on a banknote, the color eigenvalue corresponding to the multispectral signal collected by the CIS to be detected may be obtained. Contrary to the standard CIS, the CIS to be detected is a CIS which has not been tested and checked. Because of a manufacturing technique, it may be considered that, there are differences between the CIS to be detected and the standard CIS, and there are also some differences between multispectral signals outputted by the two CISs.

It should be noted that, experiments show that differences among signals outputted by different CISs are linear. That is, by means of a constant linear conversion, a multispectral signal collected by a CIS to be detected may have a value approximate to a value of a signal directly collected by a standard CIS.

In step 203, a correction conversion value is obtained according to the standard eigenvalue and the color eigenvalue.

After the standard eigenvalue and the color eigenvalue are obtained, the correction conversion value may be obtained according to the standard eigenvalue and the color eigenvalue. The correction conversion value includes a conversion relation between the standard eigenvalue and the color eigenvalue. It can be seen from above that, one of the standard eigenvalue and the color eigenvalue may be obtained by the other one through a constant linear conversion. Conversely, in a case that the standard eigenvalue and the color eigenvalue are known, a constant value of the linear conversion, i.e., the correction conversion value, may be computed.

In step 204, white balance detection is performed on a multispectral signal outputted by the CIS.

Before collecting signals by the CIS, white balance detection may be performed on the multispectral signal outputted by the CIS. The white balance detection may be classified into white balance detection of white paper and white balance detection of black paper. The detailed process of the white balance detection will be described in detail in the following practical application scenarios, which is not described herein.

In step 205, it is determined whether the CIS passes the white balance detection, if so, the process proceeds to step 207, and if not, the process proceeds to step 206.

After the white balance detection is performed on the multispectral signal outputted by the CIS, it may be determined whether the CIS passes the white balance detection, if so, the process proceeds to step 207, and if not, the process proceeds to step 206.

In step 206, the banknote classifying process is suspended.

In a case that the CIS does not pass the white balance detection, it indicates that a deviation of the multispectral signal outputted by the CIS is significant, and thus the banknote classifying process may be suspended.

In step 207, a multispectral signal collected by the CIS is obtained.

In a case that the CIS passes the white balance detection, it indicates that a deviation of the multispectral signal outputted by the CIS is small and within a reasonable range, and thus the multispectral signal collected by the CIS may be obtained.

In step 208, a first eigenvalue of the multispectral signal is extracted.

After the multispectral signal collected by the CIS is obtained, the first eigenvalue of the multispectral signal may be extracted. The Process of extracting the first eigenvalue of the multispectral signal is similar to that of obtaining the color eigenvalue corresponding to the multispectral signal collected by the CIS to be detected in above step 202, which is not repeated herein.

In step 209, a corresponding second eigenvalue is obtained according to the first eigenvalue and a pre-set correction conversion value.

After the first eigenvalue is obtained, the corresponding second eigenvalue may be obtained according to the first eigenvalue and the pre-set correction conversion value. It may be understood that, the correction conversion value has been obtained in advance before banknotes are classified, and the correction conversion value includes a conversion relation between the standard eigenvalue and the color eigenvalue, i.e., a conversion relation between the first eigenvalue and the second eigenvalue. Therefore, the corresponding second eigenvalue may be obtained according to the first eigenvalue and the pre-set correction conversion value.

In step 210, the second eigenvalue is inputted into a banknote classifier to obtain a corresponding banknote classification result.

After the corresponding second eigenvalue is obtained, the second eigenvalue may be inputted into the banknote classifier to obtain the corresponding banknote classification result.

In this embodiment, the signal quality of a multispectral signal outputted by a CIS may be evaluated simply and quickly by performing white balance detection on the multispectral signal outputted by the CIS. In a case that the signal outputted by the CIS has a large deviation, the banknote classification process is suspended, to avoid affecting the accuracy of banknote identification.

For ease of understanding, based on the embodiment as shown in FIG. 2, a practical application scenario of the quality control method for banknote identification is described according to the embodiments of the present disclosure.

The quality control method for banknote identification in this practical application scenario includes mainly signal evaluation and signal correction. The signal evaluation is to detect the color stability of output signals of a CIS and to evaluate whether there is a color cast defect in the output signals of the CIS. The evaluation process requires no human participation, and the detection method is simple and reliable. The signal correction is to eliminate a deviation of color signals among different CIS s, and includes color correction model training and color correction.

Figure 3:
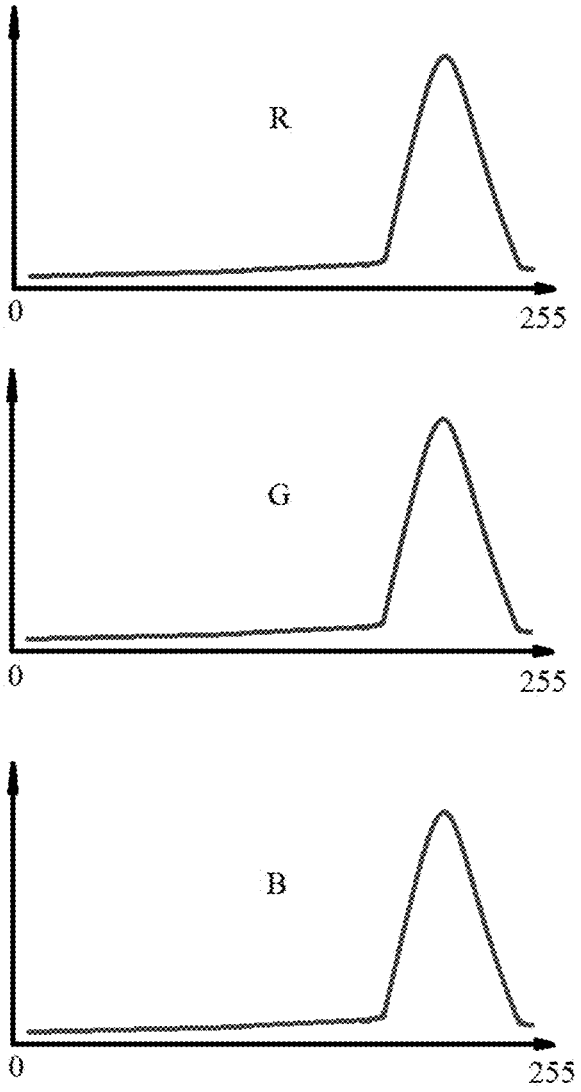
FIG. 3 illustrates histograms of RGB images of a white paper.
Figure 4:
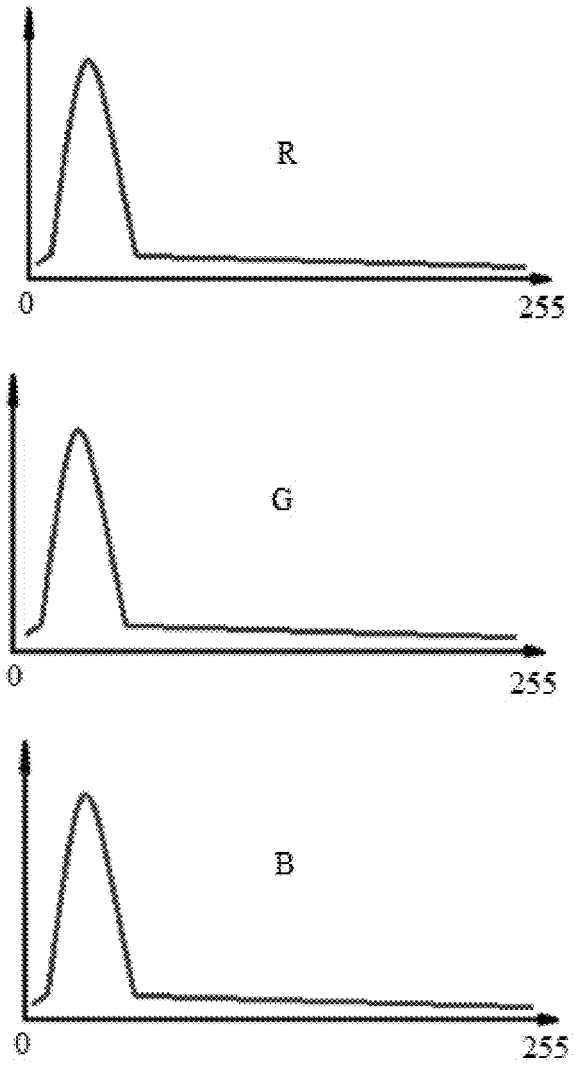
FIG. 4 illustrates histograms of RGB images of a black paper.

The signal evaluation is mainly to detect signals by applying principles of color white balance detection. In a case that a white paper meets white balance, shapes of histograms of the three colors, i.e., red, green and blue, are basically the same, that is, the three histograms of the three colors are basically overlapped, and color values gather around a position near 255 and are normally distributed, as shown in FIG. 3. Similarly, in a case that a black paper meets white balance, shapes of histograms of the three colors, i.e., red, green and blue, are also basically the same, and color values gather around a position near 0 and are normally distributed, as shown in FIG. 4.

Figure 5:
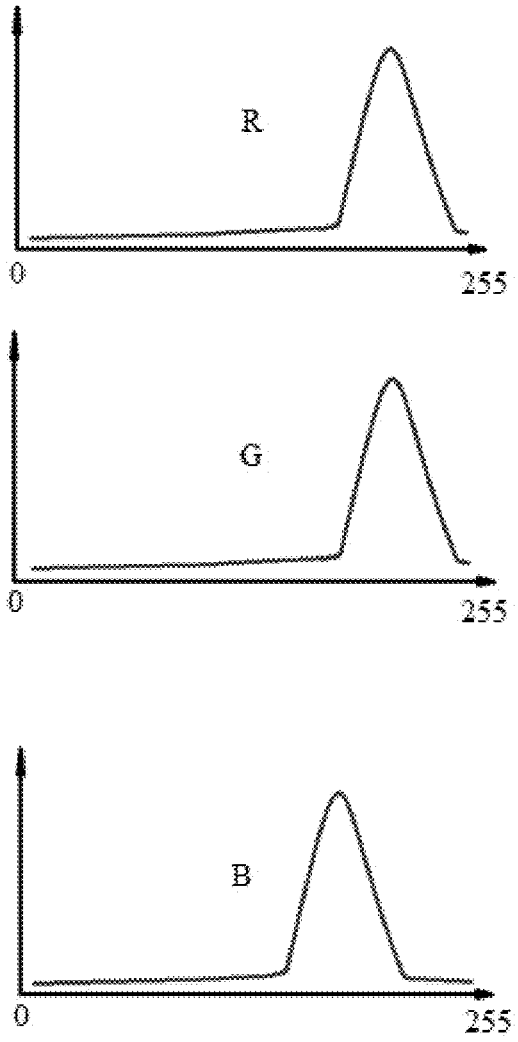
FIG. 5 is a schematic diagram of histograms, in which an average value of a blue component shifts.
Figure 6:
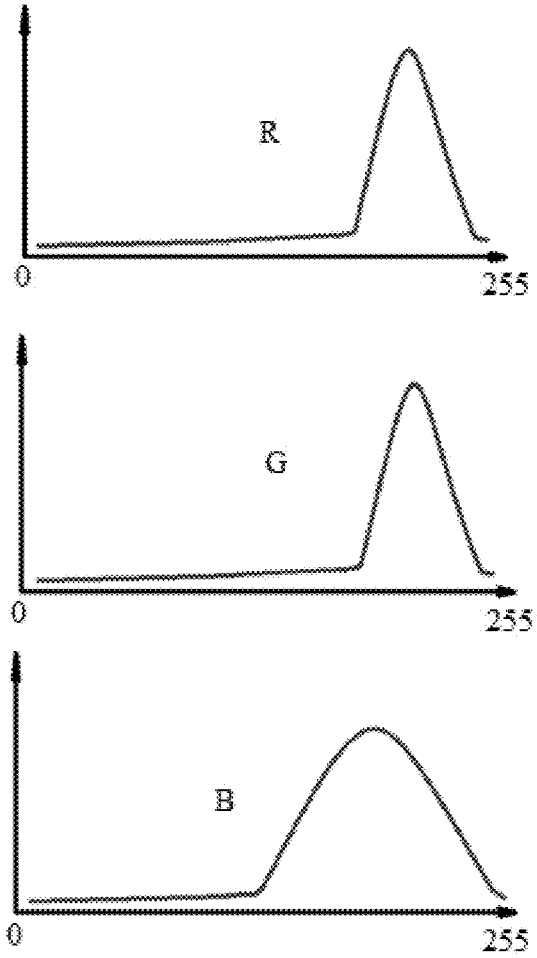
FIG. 6 is a schematic diagram of histograms, in which an average value of a blue component shifts and dynamic range of the blue component is enlarged.

If the color cast occurs in an image signal, the shift or out of shape will occur in histogram distributions of one or several RGB signals. For example, in FIG. 5, an average value of a blue distribution of a white paper shifts, and in FIG. 6, an average value of a blue distribution of a white paper shifts and a dynamic scope is enlarged.

Figure 7:
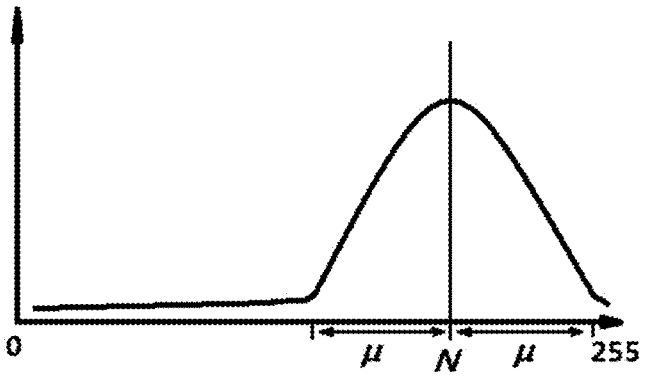
FIG. 7 is a schematic diagram of characteristic parameters to be obtained by color cast detection.

Since regularities of color distributions of a white paper and a black paper are constant, and collected signal features are stable, a shape of color distribution may be accurately described only with an average value N and a dynamic range μ (or a standard deviation) of a distribution, as shown in FIG. 7.

Therefore, whether the color cast occurs on a CIS signal may be detected by computing values of N and μ of three signals of red, green and blue of the CIS and determining whether each of the values of N and μ of every signal meets a test criterion.

The detailed process of the white balance detection of white paper in the practical scenario is described below.

Figure 8:
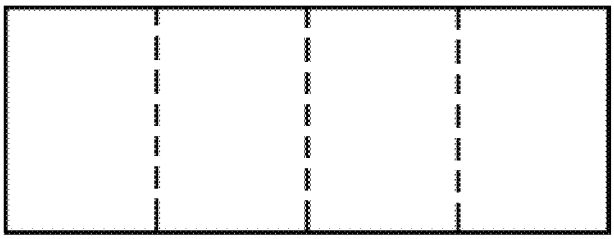
FIG. 8 is a schematic diagram of a white paper image equally divided into n regions in a transverse direction.

In a first step, signals of a red image, a green image and a blue image of a standard white detection paper are collected, and the three images are equally divided into n regions in a transverse direction (n is obtained according to experiences in a production process and n takes 4 here from experience, as shown in FIG. 8). Signal properties of transverse regions are not the same depending on a property of a CIS.

In a second step, histograms of images of RGB three colors in a first region are respectively calculated.

In a third step, average values of pixel points whose ratios are within a range of 10% to 95% in the histograms of the images of all the colors are calculated in sequence to obtain N.

In a fourth step, taking N as a midpoint, the number of pixel points whose pixel values are smaller than N and whose ratios are equal to 40% is calculated to obtain a minimum value min among those points, and taking N as a midpoint, the number of pixel points whose pixel values are greater than or equal to N and whose ratios are equal to 40% is calculated to obtain a maximum value max among those points, and let μ=(max+min)/2.

In a fifth step, the calculated average values of the images of RGB three colors are respectively recorded as $N_R$, $N_G$, $N_B$, and the calculated dynamic ranges of the images of RGB three colors are respectively recorded as $\mu_R$, $\mu_G$, $\mu_B$. The process proceeds to the third step to calculate $N_R$, $N_G$, $N_B$ and $\mu_R$, $\mu_G$, $\mu_B$ of the other regions, and the process proceeds to the sixth step if all the regions are calculated.

In a sixth step, more than 100 white papers with the same property are collected, a loop of the second to fifth step is executed to calculate $N_R$, $N_G$, $N_B$ and $\mu_R$, $\mu_G$, $\mu_B$ of each region of all the white papers, and average values $\overline{N_R}$, $\overline{N_G}$, $\overline{N_B}$, $\overline{\mu_R}$, $\overline{\mu_G}$, $\overline{\mu_B}$ of each region are calculated.

In a seventh step, parameters are determined according to the following determination criterions: $\overline{N_R}\in[0.98\ W,1.02\ W]$, $\overline{N_G}\in[0.98\ W,1.02\ W]$, $\overline{N_B}\in[0.98\ W,1.02\ W]$, $|\overline{N_R}-\overline{N_B}|<5$, $|\overline{N_R}-\overline{N_G}|<5$, $|\overline{N_G}-\overline{N_B}|<5$, where W=210 according to an empirical value; and $\overline{\mu_R}\in[0,1.5\mu_0]$, $\overline{\mu_G}[0,1.5\mu_0]$, $\overline{\mu_B}\in[0,1.5\mu_0]$, $|\overline{\mu_R}-\overline{\mu_B}|<5$, $|\overline{\mu_R}-\overline{\mu_G}|<5$, $|\overline{\mu_G}-\overline{\mu_B}|<5$, where $\mu_0=10$ according to an empirical value.

In an eighth step, in a case that $\overline{N_R}$, $\overline{N_G}$, $\overline{N_B}$, $\overline{\mu_R}$, $\overline{\mu_G}$, $\overline{\mu_B}$ of all the regions satisfy the determination criterions, the white balance detection of white paper passes, and in a case that one condition of the determination criterions is not satisfied, the loop is broken (or the banknote classification process is suspended), it indicates that the signal outputted by the CIS has a color deviation.

Similarly, the detailed process of the white balance detection of black paper is described below.

In a first step, signals of a standard black detection paper are collected in a similar way to the above.

In a second step, histograms of images of RGB three colors in a first region are respectively calculated.

In a third step, average values of pixel points whose ratios are within a range of 0% to 90% in the histograms of the images of all the colors are calculated in sequence to obtain N.

In a fourth step, taking N as a midpoint, the number of pixel points whose pixel values are smaller than N and whose ratios are equal to 40% is calculated to obtain a minimum value min among those points, and taking N as a midpoint, the number of pixel points whose pixel values are greater than or equal to N and whose ratios are equal to 40% is calculated to obtain a maximum value max among those points, and let μ=(max+min)/2.

In a fifth step, the calculated average values of the images of RGB three colors are respectively recorded as $N_R$, $N_G$, $N_B$, and the calculated dynamic ranges of the images of RGB three colors are respectively recorded as $\mu_R$, $\mu_G$, $\mu_B$. The process proceeds to the third step to calculate $N_R$, $N_G$, $N_B$ and $\mu_R$, $\mu_G$, $\mu_B$ of the other regions, and the process proceeds to the sixth step if all the regions are calculated.

In a sixth step, more than 100 black papers with the same property are collected, a loop of the second to fifth step is executed to calculate $N_R$, $N_G$, $N_B$ and $\mu_R$, $\mu_G$, $\mu_B$ of each region of all the white papers, and average values $\overline{N_R}$, $\overline{N_G}$, $\overline{N_B}$, $\overline{\mu_R}$, $\overline{\mu_G}$, $\overline{\mu_B}$ of each region are calculated.

In a seventh step, parameters are determined according to the following determination criterions: $\overline{N_R}\in[0,V]$, $\overline{N_G}\in[0,V]$, $\overline{N_B}\in[0,V]$, $|\overline{N_R}-\overline{N_B}|<5$, $|\overline{N_R}-\overline{N_G}|<5$, $|\overline{N_G}-\overline{N_B}|<5$, where V=10 according to an empirical value; and $\overline{\mu_R}\in[0,\mu_0]$, $\overline{\mu_G}\in[0,\mu_0]$, $\overline{\mu_B}\in[0,\mu_0]$, $|\overline{\mu_R}-\overline{\mu_B}|<5$, $|\overline{\mu_R}-\overline{\mu_G}|<5$, $|\overline{\mu_G}-\overline{\mu_B}|<5$, where $\mu_0=10$ according to an empirical value.

In an eighth step, in a case that $\overline{N_R}$, $\overline{N_G}$, $\overline{N_B}$, $\overline{\mu_R}$, $\overline{\mu_G}$, $\overline{\mu_B}$ of all the regions satisfy the determination criterions, the white balance detection of black paper passes, and in a case that one condition of the determination criterions is not satisfied, the loop is broken, it indicates that the signal outputted by the CIS has color deviations.

Each factory-fresh CIS should pass the white balance detection of white paper and the white balance detection of black paper, which ensures that red, green and blue signals outputted by each CIS are relatively stable and have no severe color cast.

By the above detections, a standard banknote identification module meeting a test criterion cannot ensure nonoccurrence of color cast in practical engineering applications, and only controls the extent of color cast within an eligible and small range. The signal correction of the quality control method in the application scenario is mainly used to correct the color cast with such small amplitude.

It is assumed that a banknote classifier is designed and developed based on a signal obtained by a reference CIS, that is, a standard classifier $classifier_s$ is designed by engineers based on features obtained by a reference CIS. For example, a reference CIS, which is $CIS_0$, extracts a feature of one color which is $feat_0=(r_0\ g_0\ b_0)^T$, and another CIS, such as $CIS_1$, extracts a feature of the same color under the same condition which is $feat_1=(r_1\ g_1\ b_1)^T$. In practical engineering applications, $feat_0$ and $feat_1$ are impossible to be exactly the same and a deviation exists. If a banknote identification system directly inputs $feat_1$ obtained in $CIS_1$ into the standard classifier $classifier_s$, an error will be produced inevitably in a classification result of the classifier, and there is a risk of mistaken identification, thereby reducing the identification accuracy of the banknote identification module.

The color correction method proposed in the application scenario is to establish a conversion model from $CIS_1$ to $CIS_0$ and to correct a signal eigenvalue in $CIS_1$ which is $feat_1=(r_1\ g_1\ b_1)^T$ to a signal eigenvalue in $CIS_0$ which is $feat_1'=(r_1'\ g_1'\ b_1')^T$.

Engineering experiments show that differences among different CIS signals are linear in the case of a small deviation, namely, on the basis of satisfying a test criterion set by a signal estimation unit, and in this case, via a constant linear conversion, a signal collected by $CIS_1$ can have a value approximate to a value of a signal directly collected by $CIS_0$. The conversion satisfies the following rules, $$\begin{pmatrix} r_1' \\ g_1' \\ b_1' \end{pmatrix} = \begin{pmatrix} A_1 & B_1 & C_1 \\ D_1 & E_1 & F_1 \\ G_1 & H_1 & I_1 \end{pmatrix} \begin{pmatrix} r_1 \\ g_1 \\ b_1 \end{pmatrix},$$

where $A_1+B_1+C_1=1$ $D_1+E_1+F_1=1$ and $G_1+H_1+I_1=1$, and a conversion matrix is $$\Phi_1 = \begin{pmatrix} A_1 & B_1 & C_1 \\ D_1 & E_1 & F_1 \\ G_1 & H_1 & I_1 \end{pmatrix}.$$

Figure 9:
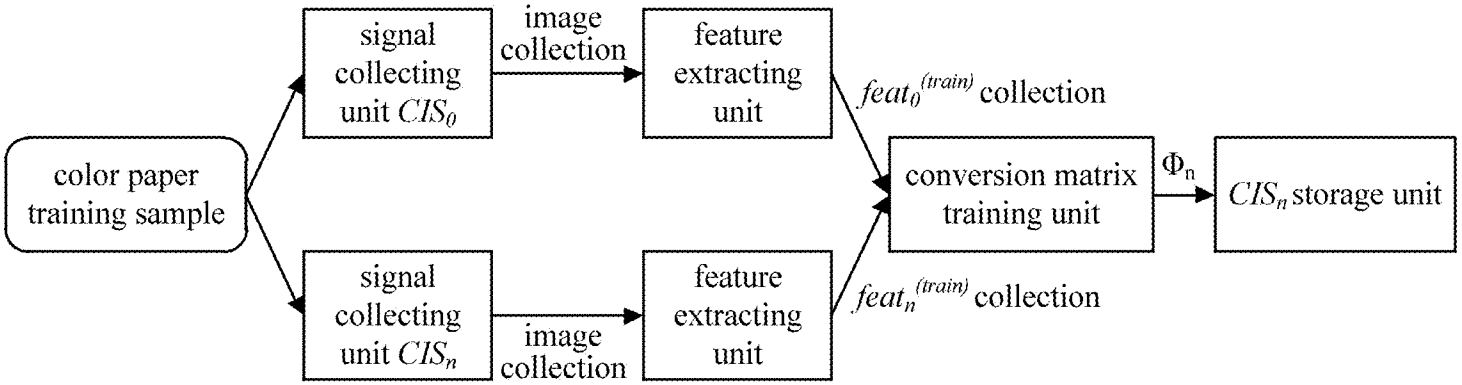
FIG. 9 is a schematic diagram of a training unit of a color correction model.

Each CIS corresponds to a unique conversion matrix, denoted as a conversion matrix $\Phi_n$ corresponding to $CIS_n$. The conversion matrix $\Phi_n$ is obtained by a color correction model training unit, and a structural diagram of the color correction model training unit is shown in FIG. 9.

The color correction model training unit functions to establish a signal correction model, and the detailed steps are as follows.

In a first step, a CIS with a high color accuracy is selected as a reference CIS, which is assumed to be $CIS_0$, a multispectral signal outputted by $CIS_0$ is taken as a reference signal for designing a banknote classifier to develop a standard classifier $classifier_s$.

In a second step, color base values of $CIS_0$ are measured, and multiple colors are selected. For example, five colors are selected, which are red, green, blue, yellow and purple, and standard checking papers of those colors are printed. Images of a red paper are collected for m times by $CIS_0$, color features $feat_{01}^{(1)}$, $feat_{02}^{(1)}$, . . . , $feat_{0n}^{(1)}$ of the obtained images are recorded every time, and color base values of the red standard paper in $CIS_0$ are $$feat_0^{(train1)} = \sum_{i=1}^{m} feat_{0i}^{(1)}/m \text{ and } feat_0^{(train1)} = (r_0^{(1)}\ \ g_0^{(1)}\ \ b_0^{(1)})^T.$$

In a third step, similarly, images of papers of the other colors are respectively collected for m times, and color base values of the green, blue, yellow and purple papers in $CIS_0$ are respectively calculated, which are respectively $feat_0^{(train2)}=(r_0^{(2)}\ g_0^{(2)}\ b_0^{(2)})^T$, $feat_0^{(train3)}=(r_0^{(3)}\ g_0^{(3)}\ b_0^{(3)})^T$, $feat_0^{(train4)}=(r_0^{(4)}\ g_0^{(4)}\ b_0^{(4)})^T$, and $feat_0^{(train5)}=(r_0^{(5)}\ g_0^{(5)}\ b_0^{(5)})^T$.

In a fourth step, color base values in $CIS_n$ to be detected are measured. Images of the red, green, blue, yellow and purple papers are collected for m times by $CIS_n$, and color base values of the five colors in $CIS_n$ are respectively calculated, which are respectively $feat_n^{(train1)}=(r_n^{(1)}\ g_n^{(1)}\ b_n^{(1)})^T$, $feat_n^{(train2)}=(r_n^{(2)}\ g_n^{(2)}\ b_n^{(2)})^T$, $feat_n^{(train3)}=(r_n^{(3)}\ g_n^{(3)}\ b_n^{(3)})^T$, $feat_n^{(train4)}=(r_n^{(4)}\ g_n^{(4)}\ b_n^{(4)})^T$, and $feat_n^{(train5)}=(r_n^{(5)}\ g_n^{(5)}\ b_n^{(5)})^T$.

In a fifth step, a set of equations of the color base values are established based on $CIS_0$ and $CIS_n$:

$$\begin{pmatrix} r_0^{(1)} \\ g_0^{(1)} \\ b_0^{(1)} \end{pmatrix} = \begin{pmatrix} A_n & B_n & C_n \\ D_n & E_n & F_n \\ G_n & H_n & I_n \end{pmatrix} \begin{pmatrix} r_n^{(1)} \\ g_n^{(1)} \\ b_n^{(1)} \end{pmatrix}$$

...

$$\begin{pmatrix} r_0^{(k)} \\ g_0^{(k)} \\ b_0^{(k)} \end{pmatrix} = \begin{pmatrix} A_n & B_n & C_n \\ D_n & E_n & F_n \\ G_n & H_n & I_n \end{pmatrix} \begin{pmatrix} r_n^{(k)} \\ g_n^{(k)} \\ b_n^{(k)} \end{pmatrix}$$

where $$A_n + B_n + C_n = 1,\ D_n + E_n + F_n = 1,\ G_n + H_n + I_n = 1,$$

$$k = 1, 2, \ldots, 5.$$

In a sixth step, the above system of equations is solved. There are nine unknown numbers and eighteen equations, so the equation set is over-determined equations. The matrixes are expanded and the equations are sorted. The equations may be classified into three groups, there are three unknown numbers and six equations in each group, and there are three groups of over-determined equations in total:

$$\begin{aligned} &r_0^{(1)}=A_nr_n^{(1)}+B_ng_n^{(1)}+C_nb_n^{(1)} \\ &r_0^{(2)}=A_nr_n^{(2)}+B_ng_n^{(2)}+C_nb_n^{(2)} \\ &r_0^{(3)}=A_nr_n^{(3)}+B_ng_n^{(3)}+C_nb_n^{(3)} \\ &r_0^{(4)}=A_nr_n^{(4)}+B_ng_n^{(4)}+C_nb_n^{(4)} \\ &r_0^{(5)}=A_nr_n^{(5)}+B_ng_n^{(5)}+C_nb_n^{(5)} \\ &A_n+B_n+C_n=1 \qquad (1) \\ &g_0^{(1)}=D_nr_n^{(1)}+E_ng_n^{(1)}+F_nb_n^{(1)} \end{aligned}$$

$$g_0^{(2)}=D_n r_n^{(2)}+E_n g_n^{(2)}+F_n b_n^{(2)}$$

$$g_0^{(3)}=D_n r_n^{(3)}+E_n g_n^{(3)}+F_n b_n^{(3)}$$

$$g_0^{(4)}=D_n r_n^{(4)}+E_n g_n^{(4)}+F_n b_n^{(4)}$$

$$g_0^{(5)}=D_n r_n^{(5)}+E_n g_n^{(5)}+F_n b_n^{(5)}$$

$$D_n+E_n+F_n=1 \quad (2)$$

$$b_0^{(1)}=G_n r_n^{(1)}+H_n g_n^{(1)}+I_n b_n^{(1)}$$

$$b_0^{(2)}=G_n r_n^{(2)}+H_n g_n^{(2)}+I_n b_n^{(2)}$$

$$b_0^{(3)}=G_n r_n^{(3)}+H_n g_n^{(3)}+I_n b_n^{(3)}$$

$$b_0^{(4)}=G_n r_n^{(4)}+H_n g_n^{(4)}+I_n b_n^{(4)}$$

$$b_0^{(5)}=G_n r_n^{(5)}+H_n g_n^{(5)}+I_n b_n^{(5)}$$

$$G_n+H_n+I_n=1 \quad (3)$$

In a seventh step, least square solutions of each group of over-determined equations are solved by means of linear regression, to obtain $A_n$ $B_n$ $C_n$, $E_n$ $F_n$ $G_n$, and $G_n$ $H_n$ $I_n$ and to obtain a unique conversion matrix $$\Phi_n = \begin{pmatrix} A_n & B_n & C_n \\ D_n & E_n & F_n \\ G_n & H_n & I_n \end{pmatrix}$$

corresponding to $CIS_n$.

In an eighth step, $\Phi_n$ is stored into a storage unit corresponding to $CIS_n$.

Figure 10:
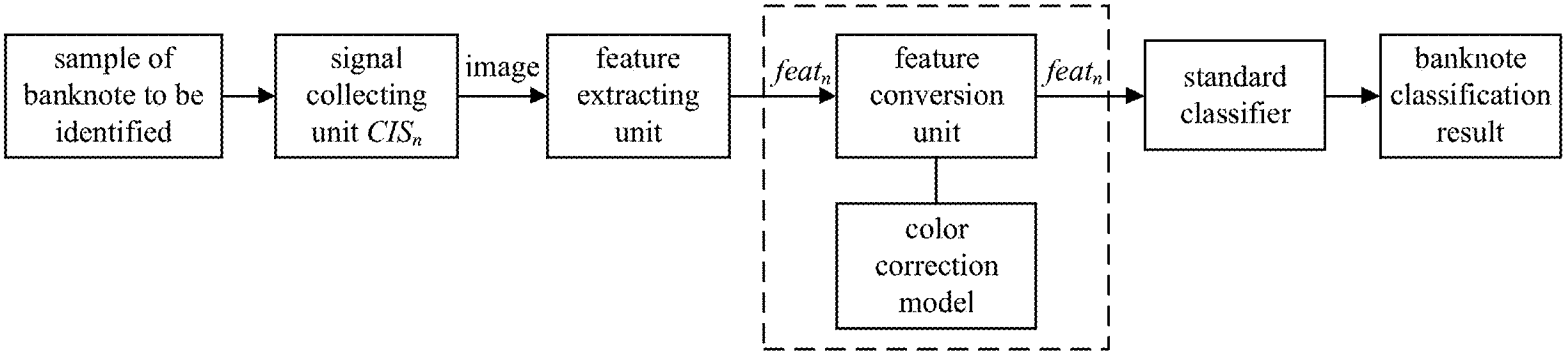
FIG. 10 is a schematic diagram of a quality control system for banknote identification applied with color correction.

After being obtained, the color correction model corresponding to $CIS_n$ is placed in an original banknote classification and identification system. A feature converting unit is added between a feature extracting unit and a standard classifier, as shown in FIG. 10. The detailed process of improved banknote identification and classification is described in the following.

In a first step, a feature $feat_n=(r_n\ g_n\ b_n)^T$ is obtained by $CIS_n$.

In a second step, the feature $feat_n$ is converted into a feature $feat_n'$ under the benchmark of a color signal of $CIS_0$. A system computing unit obtains a corresponding conversion matrix $\Phi_n$ from the storage unit and obtains $feat_n'$ by the following operations: $feat_n'=\Phi_n\ feat_n$, namely, $$\begin{pmatrix} r_n' \\ g_n' \\ b_n' \end{pmatrix} = \begin{pmatrix} A_n & B_n & C_n \\ D_n & E_n & F_n \\ G_n & H_n & I_n \end{pmatrix} \begin{pmatrix} r_n \\ g_n \\ b_n \end{pmatrix} \text{ and}$$

$$feat_n' = (r_n'\ \ g_n'\ \ b_n')^T.$$

In a third step, $feat_n'$ is inputted into the standard banknote classifier $classifier_s$, and a final banknote classification result is outputted.

Figure 11:
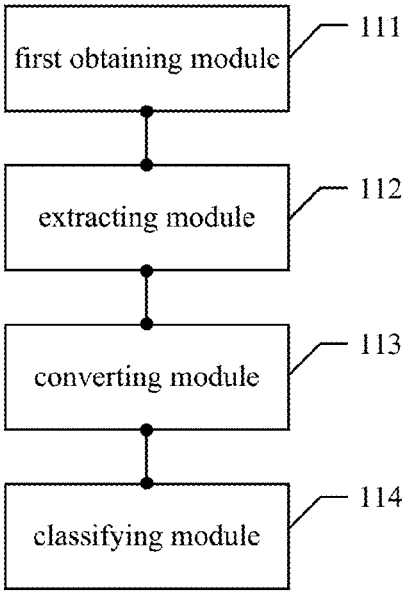
FIG. 11 is a structural diagram of a quality control system for banknote identification according to an embodiment of the present disclosure.

The quality control method for banknote identification is mainly described in the above. Hereinafter a quality control system for banknote identification is illustrated. Reference is made to FIG. 11. A quality control system for banknote identification according to an embodiment of the present disclosure includes:

a first obtaining module 111 configured to obtain a multispectral signal collected by CIS; an extracting module 112 configured to extract a first eigenvalue of the multispectral signal;

a converting module 113 configured to obtain corresponding second eigenvalue according to the first eigenvalue and a pre-set correction conversion value; and a classifying module 114 configured to input the second eigenvalue into a banknote classifier to obtain a corresponding banknote classification result.

In this embodiment, the first obtaining module 111 obtains a multispectral signal collected by a CIS, the extracting module 112 extracts a first eigenvalue of the multispectral signal, the converting module 113 obtains corresponding second eigenvalue according to the first eigenvalue and a pre-set correction conversion value, and the classifying module 114 inputs the second eigenvalue into a banknote classifier to obtain a corresponding banknote classification result. In this embodiment, after the first eigenvalue of the multispectral signal is obtained, the corresponding second eigenvalue is obtained according to the first eigenvalue and the pre-set correction conversion value to perform correction processing on the first eigenvalue, which eliminates a deviation brought by a difference in the CIS performance, thereby eliminating a difference in the finally obtained banknote classification results, ensuring the accuracy of banknote identification and eliminating a risk of mistaken identification.

Figure 12:
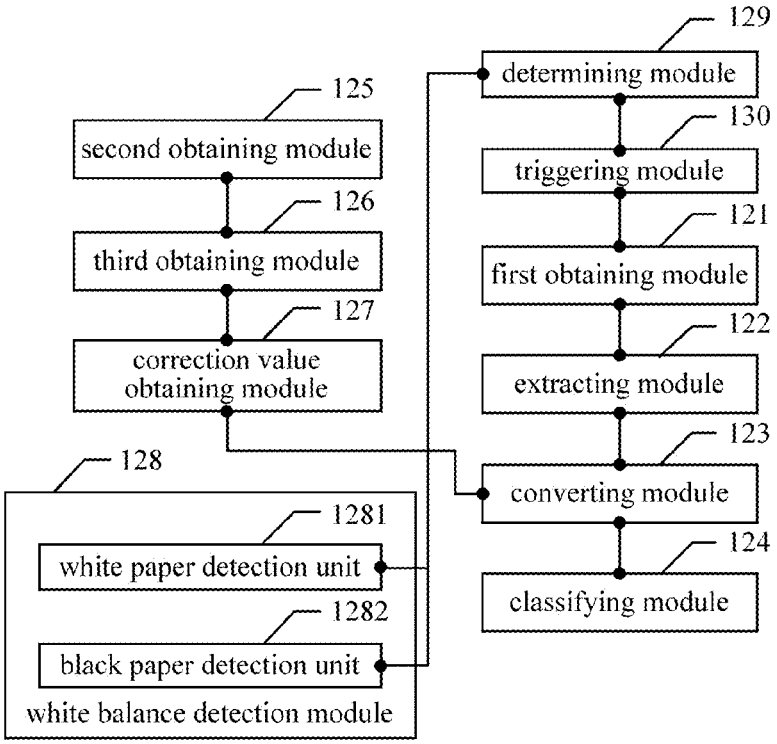
FIG. 12 is a structural diagram of a quality control system for banknote identification according to another embodiment of the present disclosure.

For ease of understanding, hereinafter the quality control system for banknote identification in the embodiments of the present disclosure is described in detail. Reference is made to FIG. 12. A quality control system for banknote identification according to another embodiment of the present disclosure includes:

a first obtaining module 121 configured to obtain a multispectral signal collected by a CIS;

an extracting module 122 configured to extract a first eigenvalue of the multispectral signal;

a converting module 123 configured to obtain corresponding second eigenvalue according to the first eigenvalue and a pre-set correction conversion value; and a classifying module 124 configured to input the second eigenvalue into a banknote classifier to obtain a corresponding banknote classification result.

The system in this embodiment further includes:

a second obtaining module 125 configured to obtain a standard eigenvalue corresponding to the multispectral signal collected by the CIS;

a third obtaining module 126 configured to obtain a color eigenvalue corresponding to a multispectral signal collected by a CIS to be detected; and a correction value obtaining module 127 configured to obtain a correction conversion value according to the standard eigenvalue and the color eigenvalue, where the correction conversion value includes a conversion relation between the standard eigenvalue and the color eigenvalue.

The system in this embodiment further includes:

a white balance detection module 128 configured to perform white balance detection on a multispectral signal outputted by the CIS;

The white balance detection module 128 in this embodiment may include:

a white paper detection unit 1281 configured to perform the white balance detection of white paper on the multispectral signal outputted by the CIS; or a black paper detection unit 1282 configured to perform the white balance detection of black paper on the multispectral signal outputted by the CIS.

The system in this embodiment further includes:

a determining module 129 configured to determine whether the CIS passes the white balance detection; and a triggering module 130 configured to trigger the first obtaining module, in a case that a determination result of the determining module is positive.

As may be clearly understood by those skills in the art, for convenience and brevity of description, the detailed operating processes of the above systems, devices and units can refer to processes corresponding to the above embodiments of the method, which are not repeated herein.

It should be understood that, the disclosed systems, devices and methods in the embodiments provided by the present application may be implemented in other manners. For example, the above embodiments of the device are only illustrative. For example, dividing the units is only based on logical functions, and there are other dividing modes in practical implementations. For example, multiple units or components can be combined or integrated into another system, or some features can be ignored or not be executed. In addition, coupling among shown or discussed parts which may be direct coupling or communication connection can be via some interfaces, and the direct coupling or communication connection among devices or units can be electrical, mechanical or other forms.

Units for showing separation components may or not may be separated physically. Components for displaying units may or not may be a physical unit, that is, may be located in a position, or may be distributed to multiple network units. Some or all of units may be selected to implement objects of the technical solutions according to the embodiments, according to practical requirements.

In addition, various function units according to various embodiments of the present disclosure may be integrated into a processing unit, or various function units may exist independently, or two or more than two of the above units may be integrated into a unit. The above integrated units may be implemented in a form of hardware, or in a form of a software function unit.

The integrated unit can be stored in a readable storage medium of a computing device, if the functions are implemented in a form of a soft function unit and sold or used as an independent product. Based on that insight, the technical solutions according to the present application essentially or contributing to the conventional technology or all or some of the technical solutions can be embodied in a form of a software product, and the computer software product is stored in a storage medium, which includes several instructions used for a computing device (may be a personal computer, a server, or a network device) to execute all or some of steps described in various embodiments of the present disclosure. The storage medium in the forgoing includes various media which can store program codes, such as, a USB disk, a removable hard disk, a read-only memory (ROM), a random access memory (RAM), a magnetic disk, or an optical disk.

The above embodiments are only intended to illustrate the technical solutions of the present disclosure, but not to limit the present disclosure. Even though the present disclosure is illustrated in detail referring to the above embodiments, it should be understood by those skilled in the art, the technical solutions according to the above embodiments can be modified, or some technical features in the technical solutions can be substituted by equivalents; and those modifications or substitutes do not make the essence of the technical solutions depart from the spirit and scope of the technical solutions according to the embodiments of the present disclosure.

The invention claimed is:

1. A quality control method for banknote identification, comprising:

obtaining a multispectral signal collected by a contact image sensor (CIS);

extracting a first feature value of the multispectral signal;

training, with one or more pre-set color, both a standard CIS and a CIS to be detected, to obtain a pre-set correction conversion value;

obtaining a corresponding second feature value according to the first feature value and the pre-set correction conversion value; and inputting the second feature value into a banknote classifier to obtain a corresponding banknote classification result.

2. The method according to claim 1, wherein training, with the one or more pre-set color, both the standard CIS and the CIS to be detected, to obtain the pre-set correction conversion value comprises:

obtaining a standard feature value corresponding to a multispectral signal collected by the standard CIS;

obtaining a color feature value corresponding to a multispectral signal collected by the CIS to be detected; and obtaining the correction conversion value according to the standard feature value and the color feature value, wherein the correction conversion value comprises a conversion relation between the standard feature value and the color feature value.

3. The method according to claim 1, further comprising performing white balance detection on a multispectral signal outputted by the CIS.

4. The method according to claim 3, wherein the performing white balance detection on the multispectral signal outputted by the CIS comprises:

performing white balance detection of white paper on the multispectral signal outputted by the CIS; or performing white balance detection of black paper on the multispectral signal outputted by the CIS.

5. The method according to claim 3, further comprising:

determining whether the CIS passes the white balance detection, wherein the step of obtaining a multispectral signal collected by a CIS is performed in a case that it is determined that the CIS passes the white balance detection.

6. A quality control system for banknote identification, comprising:

a first obtaining processor configured to obtain a multispectral signal collected by a contact image sensor (CIS);

an extracting processor configured to extract a first feature value of the multispectral signal;

a correction value obtaining processor configured to train, with one or more pre-set color, both a standard CIS and a CIS to be detected, to obtain a pre-set correction conversion value;

a converting processor configured to obtain a corresponding second feature value according to the first feature value and the pre-set correction conversion value; and a classifying processor configured to input the second feature value into a banknote classifier to obtain a corresponding banknote classification result.

7. The system according to claim 6, further comprising:

a second obtaining processor configured to obtain a standard feature value corresponding to a multispectral signal collected by the standard CIS; and a third obtaining processor configured to obtain a color feature value corresponding to a multispectral signal collected by the CIS to be detected;

wherein the correction value obtaining processor is configured to obtain the correction conversion value according to the standard feature value and the color feature value, and the correction conversion value comprises a conversion relation between the standard feature value and the color feature value.

8. The system according to claim 6, further comprising a white balance detection processor configured to perform white balance detection on a multispectral signal outputted by the CIS.

9. The system according to claim 8, wherein the white balance detection processor comprises:

a white paper detection processor configured to perform white balance detection of white paper on the multispectral signal outputted by the CIS; or a black paper detection processor configured to perform white balance detection of black paper on the multispectral signal outputted by the CIS.

10. The system according to claim 8, further comprising:

a determining processor configured to determine whether the CIS passes the white balance detection; and a triggering processor configured to trigger the first obtaining processor in a case that a determination result of the determining processor is positive.

* * * * *